US005390857A

United States Patent [19]

Primdahl

[11] Patent Number: 5,390,857

[45] Date of Patent: Feb. 21, 1995

[54] GAS INJECTOR NOZZLE

[75] Inventor: Ivar I. Primdahl, Copenhagen NV, Denmark

[73] Assignee: Haldor Topsoe A/S, Lyngby, Denmark

[21] Appl. No.: 252,267

[22] Filed: Jun. 1, 1994

[51] Int. Cl.[6] ..... B05B 1/00

[52] U.S. Cl. ..... 239/589; 239/602

[58] Field of Search ..... 239/128, 132, 589, 601, 239/602

[56] References Cited

U.S. PATENT DOCUMENTS

| | | | |
|---|---|---|---|
| 361,161 | 1/1887 | Jackson | 239/601 |
| 1,028,166 | 6/1912 | Whitford | 239/589 |
| 1,947,755 | 2/1934 | Bucknam et al. | 239/128 |
| 3,487,828 | 1/1970 | Troy | 239/601 |
| 4,813,611 | 3/1989 | Fontana | 239/589 |

FOREIGN PATENT DOCUMENTS

| | | | |
|---|---|---|---|
| 698406 | 10/1940 | Germany | 239/601 |

*Primary Examiner*—Andres Kashnikow

*Assistant Examiner*—Christopher G. Trainor

*Attorney, Agent, or Firm*—Ostrolenk, Faber, Gerb & Soffen

[57] ABSTRACT

Gas injector nozzle comprising a discharge chamber with a cylindrical inner wall and having at its outlet end a circular gas discharge orifice, an outer wall concentrically surrounding the inner wall, the outer wall following a continuously curved path at a region 1 at the chamber outlet end and being joint sharp-edged with the inner wall at the discharge orifice, wherein the curved path has a curvature radius R complying with the relationship:

$$R = \frac{l - t}{\sin\alpha}$$

where 1 is as defined above, t is the maximal horizontal distance between the inner and outer wall, and $\alpha$ is the tip angle of the edge at the discharge orifice.

9 Claims, 1 Drawing Sheet

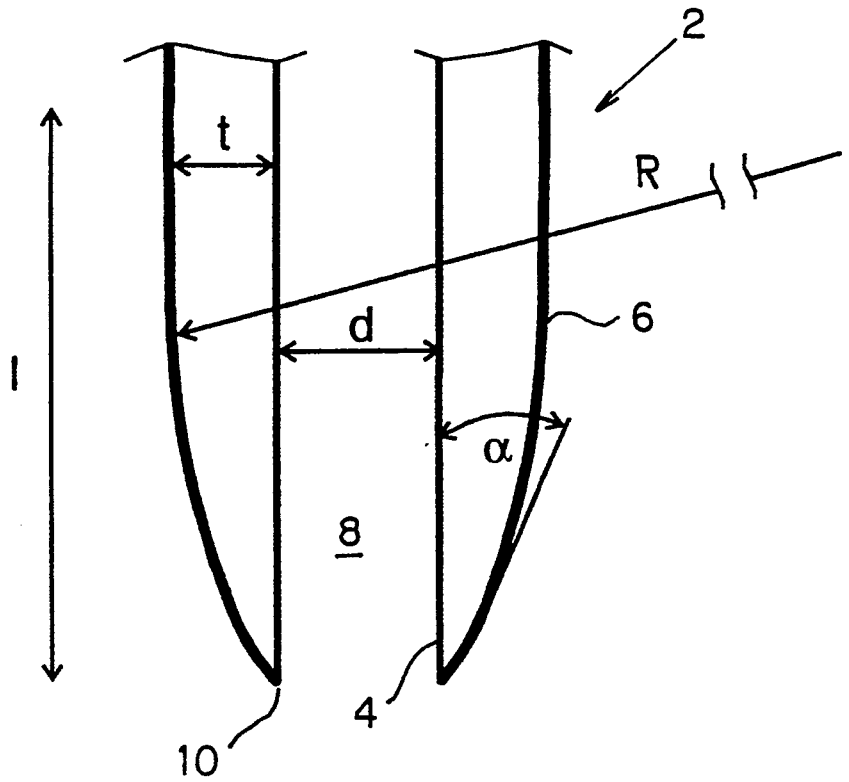
2
t
R
d
6
l
α
8
4
10

GAS INJECTOR NOZZLE

This invention relates to a gas injector nozzle, in particular to an injector nozzle for use as oxidizer supply nozzle in a burner.

Nozzles of this type are used in gas-fuelled industrial burners and process heaters, which require a stable flame with high combustion intensity. The conventionally designed burners include an injector tube for fuel supply and a nozzle for oxidizer supply. Intensive mixing of fuel and oxidizer in a combustion zone is achieved by injecting the oxidizer through the nozzle installed at the burner face. A stream of oxidizer is, thereby, given a high velocity, which provides a high degree of internal and external recirculation of combustion products and thus a high combustion intensity.

As a general drawback of conventional nozzle design, the nozzle face is at high gas flow velocities, as required for industrial applications, exposed to overheating caused by high combustion intensities in close vicinity to the nozzle face. Hot combustion products flow, thereby, back towards the nozzle face, which results in a rapid heating up to high temperatures and, consequently, destruction of the face.

The general object of this invention is to eliminate this problem by an improved design of a gas injector nozzle.

This improved design is based on the observation that a stable flame with high combustion intensity at a safe distance from the nozzle face is obtained when providing the nozzle with an outer wall having a continuously curved shape with an optimal curvature radius narrowing towards the outlet end of the nozzle.

In accordance with this observation, the gas injector nozzle of this invention comprises a discharge chamber with a cylindrical inner wall and having at its outlet end a circular gas discharge orifice, an outer wall concentrically surrounding the inner wall, the outer wall following a continuously curved path at the chamber outlet end and being joint sharp-edged with the inner wall at the discharge orifice, wherein the curved path has a curvature radius R complying with the relationship:

$$R = \frac{l - t}{\text{Sin}\alpha}$$

where 1 is the length of the continuously curved path measured along the longitudinal axis of the nozzle, t is the maximal horizontal distance between the inner and outer wall, and $\alpha$ is the tip angle between a line drawn tangent to the outer wall at the discharge orifice and the longitudinal axis of the nozzle.

The curved path of the outer nozzle wall prevents backmixing of hot combustion products close at the nozzle face.

The temperature at the discharge orifice is strongly reduced, when providing the orifice sharp-edged with a minimum tip angle. Reduced heating and suitable mechanical strength of the nozzle face are obtained at tip angles of between 7° and 20°, preferably between 12° and 18°.

Furthermore, at a length of region 1 being between 1.5 and 5, preferably between 2 and 3, times the magnitude of the inner diameter of the cylindrical discharge chamber, the mixing intensity of oxidizer and fuel is very low around the nozzle face, resulting in a very low reduced or no combustion adjacent to the nozzle face.

The oxidizer is, thereby, discharged at high velocity and mixing and combustion of fuel with oxidizer takes place in a combustion zone being at a removed distance from the nozzle face.

A proper inner diameter of the nozzle discharge chamber will be between 0.010 and 0.050 meter, preferably between 0.025 and 0.028 meter. The distance t between the inner and outer wall corresponding to the maximum nozzle wall thickness will, thereby, beat 0.002–0.008 meters, preferably at 0.003–0.006 meters.

The invention is illustrated in the drawing, in which the sole FIGURE is a sectional view of a gas injector nozzle according to a specific embodiment of the invention.

The FIGURE shows a cross sectional view through a gas injector nozzle 2. Nozzle 2 is provided with a gas passage 8 confined by a cylindrical inner wall 4. An outer wall 6 concentrically surrounds gas passage 8 at a maximal distance, nozzle wall thickness t.

Outerwall 6 is continuously narrowed towards orifice 10 following a curved path having a curvature radius R over a length 1. Outer wall 6 meets inner wall 4 at orifice 10 forming a sharp edge around the orifice with a tip angle $\alpha$.

I claim:

1. Gas injector nozzle comprising a discharge chamber with a cylindrical inner wall and having at its outlet end a circular gas discharge orifice, an outer wall concentrically surrounding the inner wall, the outer wall following a continuously curved path at the chamber outlet end and being joint sharp-edged with the inner wall at the discharge orifice, wherein the curved path has a curvature radius R complying with the relationship:

$$R = \frac{l - t}{\text{Sin}\alpha}$$

where 1 is the length of the continuously curved path measured along the longitudinal axis of the nozzle, t is the maximal horizontal distance between the inner and outer wall, and $\alpha$ is the tip angle between a line drawn tangent to the outer wall at the discharge orifice and the longitudinal axis of the nozzle.

2. A gas injector nozzle according to claim 1, wherein the tip angle $\alpha$ is between 7° and 20°.

3. A gas injector nozzle according to claim 1, wherein the tip angle $\alpha$ is between 12° and 18°.

4. A gas injector nozzle according to claim 1, wherein the length 1 is between 1.5 and 5 times the magnitude of the inner diameter of the discharge chamber.

5. A gas injector nozzle according to claim 1, wherein the length 1 is between 2 and 3 times the magnitude of the inner diameter of the discharge chamber.

6. A gas injector nozzle according to claim 1, wherein the inner diameter of the discharge chamber is between 0.010 and 0.050 meter.

7. A gas injector nozzle according to claim 1, wherein the inner diameter of the discharge chamber is between 0.025 and 0.028 meter.

8. A gas injector nozzle according to claim 1, wherein the inner distance t between the outer and inner wall is 0.002–0.008 meters.

9. A gas injector nozzle according to claim 1, wherein distance t between the outer and inner wall is 0.003–0.006 meters.

* * * * *